US008918040B2

(12) United States Patent
Ishida et al.

(10) Patent No.: US 8,918,040 B2
(45) Date of Patent: Dec. 23, 2014

(54) FUSER UNIT

(75) Inventors: Kei Ishida, Nagoya (JP); Noboru Suzuki, Komaki (JP); Takuji Matsuno, Ichinomiya (JP); Yoshihiro Miyauchi, Ama (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 302 days.

(21) Appl. No.: 13/370,467

(22) Filed: Feb. 10, 2012

(65) Prior Publication Data

US 2012/0251207 A1 Oct. 4, 2012

(30) Foreign Application Priority Data

Mar. 31, 2011 (JP) ..... 2011-078328

(51) Int. Cl.
*G03G 15/20* (2006.01)

(52) U.S. Cl.
CPC ..... *G03G 15/2039* (2013.01); *G03G 15/2053* (2013.01)
USPC ..... 399/329

(58) Field of Classification Search
USPC ..... 399/329, 328
See application file for complete search history.

(56) References Cited

U.S. PATENT DOCUMENTS

| | | | | |
|---|---|---|---|---|
| 7,262,391 | B2 * | 8/2007 | Nishihara et al. | 219/619 |
| 8,346,106 | B2 | 1/2013 | Takenaka et al. | |
| 8,385,804 | B2 | 2/2013 | Yamaguchi et al. | |
| 8,412,084 | B2 * | 4/2013 | Ishida et al. | 399/329 |
| 8,494,424 | B2 * | 7/2013 | Ishida et al. | 399/329 |
| 8,515,325 | B2 * | 8/2013 | Miyauchi et al. | 399/329 |
| 8,660,445 | B2 * | 2/2014 | Ishida et al. | 399/33 |
| 2002/0039504 | A1 * | 4/2002 | Nakayama et al. | 399/328 |
| 2008/0199231 | A1 * | 8/2008 | Lee et al. | 399/329 |
| 2011/0020018 | A1 | 1/2011 | Takenaka et al. | |
| 2011/0058862 | A1 | 3/2011 | Yamaguchi et al. | |
| 2011/0164906 | A1 | 7/2011 | Ishida et al. | |
| 2011/0211882 | A1 * | 9/2011 | Suzuki et al. | 399/329 |
| 2012/0275830 | A1 * | 11/2012 | Suzuki et al. | 399/329 |
| 2012/0308276 | A1 * | 12/2012 | Miyauchi | 399/329 |
| 2012/0308277 | A1 * | 12/2012 | Suzuki et al. | 399/329 |

(Continued)

FOREIGN PATENT DOCUMENTS

| | | |
|---|---|---|
| JP | 04-122969 | 4/1992 |
| JP | 06-314040 A | 11/1994 |

(Continued)

OTHER PUBLICATIONS

Decision to grant received in corresponding JP Application No. 2011-078328 dated Feb. 26, 2013.

*Primary Examiner* — Walter L Lindsay, Jr.
*Assistant Examiner* — Rodney Bonnette
(74) *Attorney, Agent, or Firm* — Banner & Witcoff, Ltd.

(57) ABSTRACT

A fuser unit includes: a cylindrical member having flexibility; a heat generator, which is arranged at the inside of the cylindrical member; a plate-shaped nip member, which is arranged to slidingly contact an inner peripheral surface of the cylindrical member and receives radiation heat from the heat generator; a backup member, which is configured to configure a nip part between the cylindrical member and the backup member with the cylindrical member, by nipping between the backup member and the nip member; a temperature detection unit, which is arranged to face an opposite surface that is opposite to the surface of the nip member slidingly contacting the cylindrical member at the inside of the cylindrical member and detects a temperature of the nip member, and an urging member that urges the temperature detection unit toward the nip member.

20 Claims, 6 Drawing Sheets

(56) References Cited

U.S. PATENT DOCUMENTS

| | | | | |
|---|---|---|---|---|
| 2013/0071156 | A1* | 3/2013 | Suzuki et al. | 399/329 |
| 2013/0071158 | A1* | 3/2013 | Suzuki | 399/329 |
| 2013/0322937 | A1* | 12/2013 | Suzuki et al. | 399/329 |

FOREIGN PATENT DOCUMENTS

| | | | |
|---|---|---|---|
| JP | 11-016667 | A | 1/1999 |
| JP | 2002-267543 | A | 9/2002 |
| JP | 2003-005572 | A | 1/2003 |
| JP | 2006-047769 | A | 2/2006 |
| JP | 2006-251479 | | 9/2006 |
| JP | 2007-171749 | A | 7/2007 |
| JP | 2008-292551 | A | 12/2008 |
| JP | 2011-028037 | A | 2/2011 |
| JP | 2011-059364 | A | 3/2011 |
| JP | 2011-113013 | | 6/2011 |

* cited by examiner

FUSER UNIT

CROSS-REFERENCE TO RELATED APPLICATION

This application claims priority from Japanese Patent Application No. 2011-078328 filed on Mar. 31, 2011, the entire subject matter of which is incorporated herein by reference.

TECHNICAL FIELD

This disclosure relates to a fuser unit having a temperature detection unit arranged at the inside of a cylindrical member.

BACKGROUND

Regarding a fuser unit that is used in an image forming apparatus of an electrophotographic method, it is known that a fuser unit of which a heat source (heat generator) such as halogen lamp, a thermistor (temperature detecting member) and the like are arranged at the inside of a belt (heating belt) made of a heat-resistant film. In the fuser unit, the heat source is controlled based on temperatures detected by the temperature detection unit, so that a fixing temperature and the like are controlled.

SUMMARY

According to the above fuser unit, in order to control the fixing temperature in good precision, it is important that the temperature detection unit is arranged in good precision with respect to a detection object so that the temperature detection unit detects a temperature of the detection object in good accuracy. However, according to the configuration in which the temperature detection unit is arranged to be close to or to contact a heating belt having flexibility like the related art, a positional relation between the temperature detection unit and the heating belt is changed due to bending of the heating belt being rotated and the like, so that it may be not possible to detect the temperature in good precision.

In view of the above, this disclosure provides a fuser unit capable of detecting a temperature in good precision.

With considering above, a fuser unit of this disclosure comprises: a cylindrical member having flexibility; a heat generator, which is arranged at the inside of the cylindrical member; a plate-shaped nip member, which is arranged to slidingly contact an inner peripheral surface of the cylindrical member and receives radiation heat from the heat generator; a backup member, which is configured to configure a nip part between the cylindrical member and the backup member with the cylindrical member, by nipping between the backup member and the nip member; a temperature detection unit, which is arranged to face an opposite surface that is opposite to the surface of the nip member slidingly contacting the cylindrical member at the inside of the cylindrical member and detects a temperature of the nip member, and an urging member that urges the temperature detection unit toward the nip member.

According to the fuser unit configured as described above, it is provided that the nip member, which is arranged to slidingly contact the inner peripheral surface of the cylindrical member and receives radiation heat from the heat generator, and the urging member that urges the temperature detection unit toward the nip member. Accordingly, it is possible to stabilize a positional relation between the temperature detection unit and the nip member that is a detection object. Thereby, since it is possible to detect a temperature of the nip member in good precision, it is possible to control the fixing temperature in good precision.

According to this disclosure, the urging member that urges the temperature detection unit toward the nip member is provided, so that it is possible to stabilize a positional relation between the temperature detection unit and the nip member. Therefore, it is possible to detect a temperature of the nip member in good precision.

BRIEF DESCRIPTION OF THE DRAWINGS

The foregoing and additional features and characteristics of this disclosure will become more apparent from the following detailed descriptions considered with the reference to the accompanying drawings, wherein.

DETAILED DESCRIPTION

Hereinafter, illustrative embodiments of this disclosure will be described in detail with reference to the drawings. In the below, a schematic configuration of a laser printer 1 (image forming apparatus) having a fuser unit 100 according to an illustrative embodiment of this disclosure will be first described and a detailed configuration of the fuser unit 100 will be described later.

In the below descriptions, the directions are described on the basis of a user who uses the laser printer 1. That is, the right side of FIG. 1 is referred to as the 'front', the left side is referred to as the 'rear', the front side is referred to as the 'left side' and the back side is referred to as the 'right side.' Also, the upper-lower direction of FIG. 1 is referred to as the 'upper-lower.'

<Schematic Configuration of Laser Printer 1>

Figure 1:
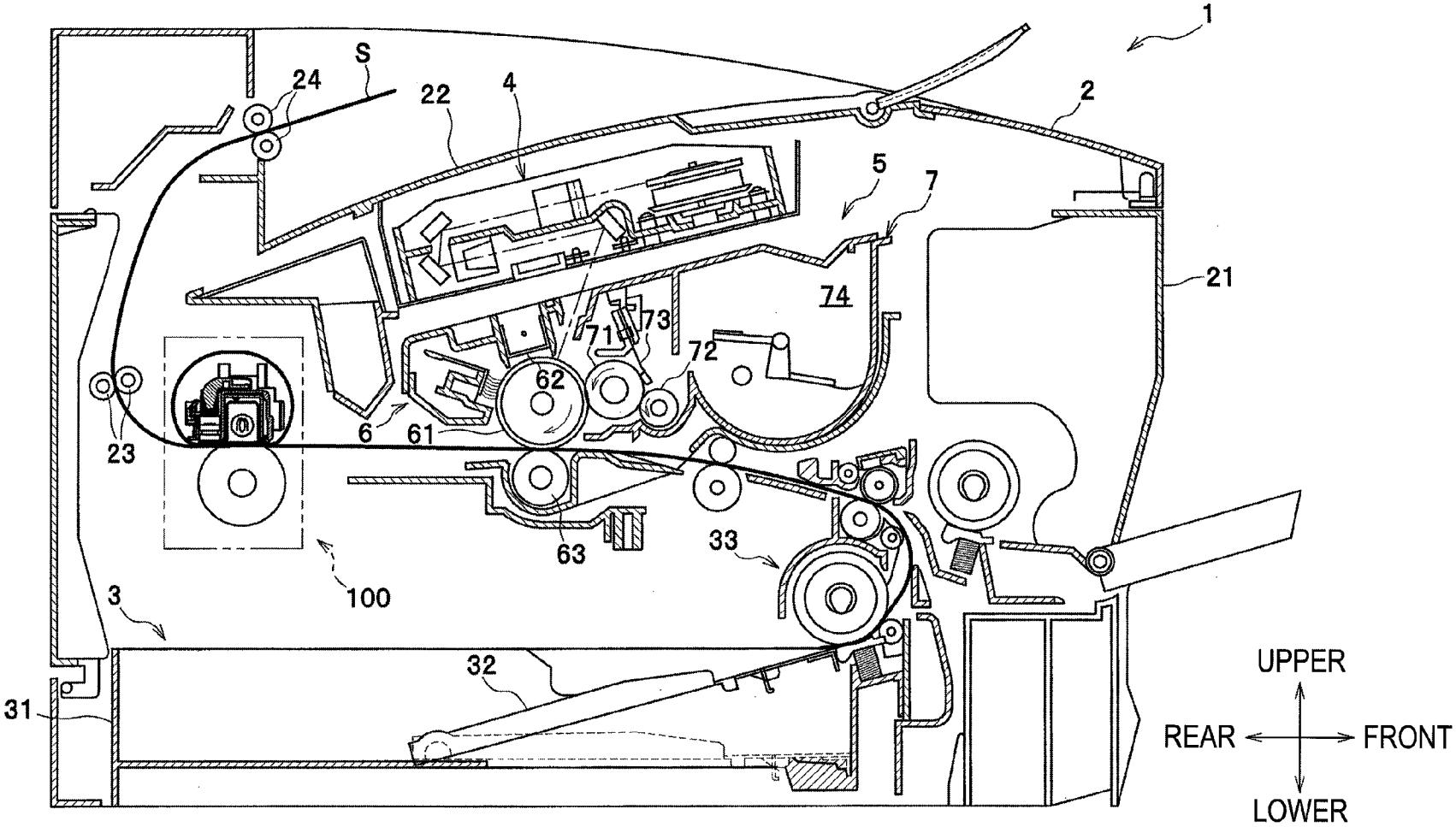
FIG. 1 illustrates a schematic configuration of a laser printer having a fuser unit according to an illustrative embodiment of this disclosure.

As shown in FIG. 1, the laser printer 1 mainly has, in a body housing 2, a feeder unit 3 that feeds a sheet S, an exposure device 4, a developing cartridge 5 that transfers a toner image (developing image) on the sheet S and a fuser unit 100 that heat-fixes the toner image on the sheet S.

The feeder unit 3 is provided at a lower part in the body housing 2 and mainly has a sheet feeding tray 31, a sheet pressing plate 32 and a sheet feeding mechanism 33. The sheet S accommodated in the sheet feeding tray 31 is upwardly inclined by the sheet pressing plate 32 and is fed toward the process cartridge 5 (between a photosensitive drum 61 and a transfer roller 63) by the sheet feeding mechanism 33.

The exposure device 4 is arranged at an upper part in the body housing 2 and has a laser emitting unit (not shown), a polygon mirror, a lens, a reflector and the like whose reference numerals are omitted. In the exposure device 4, a laser light (refer to the dotted-dashed line) based on image data, which is emitted from the laser emitting unit, is scanned on a surface of a photosensitive drum 61 at high speed, thereby exposing the surface of the photosensitive drum 61.

The process cartridge 5 is arranged below the exposure device 4 and is detachably mounted to the body housing 2 through an opening that is formed when a front cover 2 provided to the body housing 2 is opened. The process cartridge 5 has a drum unit 6 and a developing unit 7.

The drum unit 6 mainly has the photosensitive drum 61, a charger 62 and the transfer roller 63. Also, the developing unit 7 is detachably mounted to the drum unit 6 and mainly has a developing roller 71, a supply roller 72, a layer thickness regulation blade 73 and a toner accommodation unit 74 that accommodates toners (developers).

In the process cartridge 5, the surface of the photosensitive drum 61 is uniformly charged by the charger 62 and then exposed by the high-speed scanning of the laser light emitted from the exposure device 4, so that an electrostatic latent image based on image data is formed on the photosensitive drum 61. Also, the toners in the toner accommodation unit 74 are supplied to the developing roller 71 through the supply roller 72, are introduced between the developing roller 71 and the layer thickness regulation blade 73 and are carried on the developing roller 71 as a thin layer having a predetermined thickness.

The toners carried on the developing roller 71 are supplied from the developing roller 71 to the electrostatic latent image formed on the photosensitive drum 61. Thereby, the electrostatic latent image becomes visible and a toner image is formed on the photosensitive drum 61. Then, the sheet S is conveyed between the photosensitive drum 61 and the transfer roller 63, so that the toner image on the photosensitive drum 61 is transferred onto the sheet S.

The fuser unit 100 is arranged at the rear side of the process cartridge 5. The toner image (toners) transferred on the sheet S passes through the fuser unit 100, so that the toner image is heat-fixed on the sheet S. The sheet S having the toner image heat-fixed thereon is discharged on a sheet discharge tray 22 by conveyance rollers 23, 24.

<Detailed Configuration of Fuser Unit>

Figure 2:
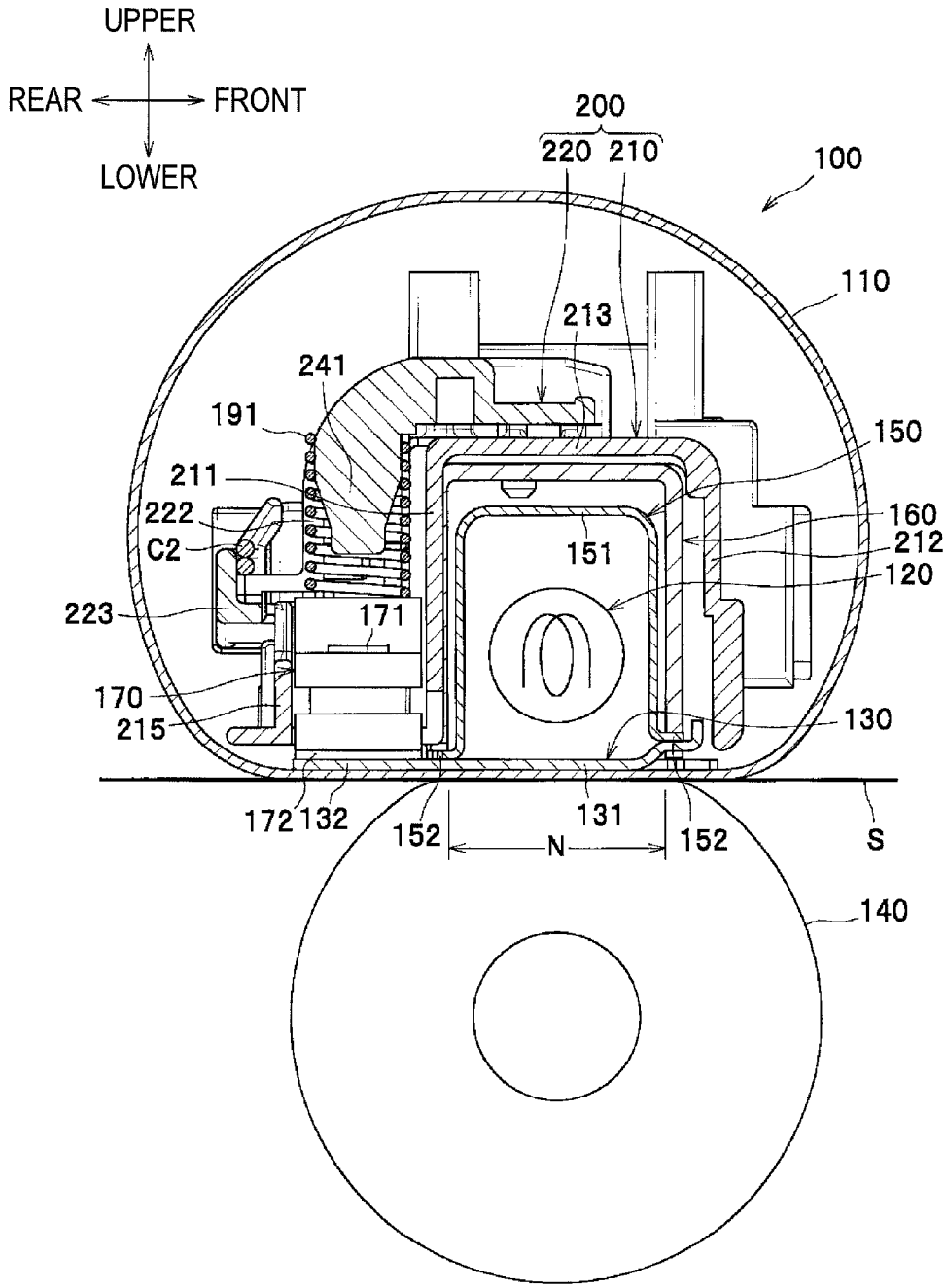
FIG. 2 is a sectional view illustrating a vicinity of a thermostat of the fuser unit.
Figure 6:
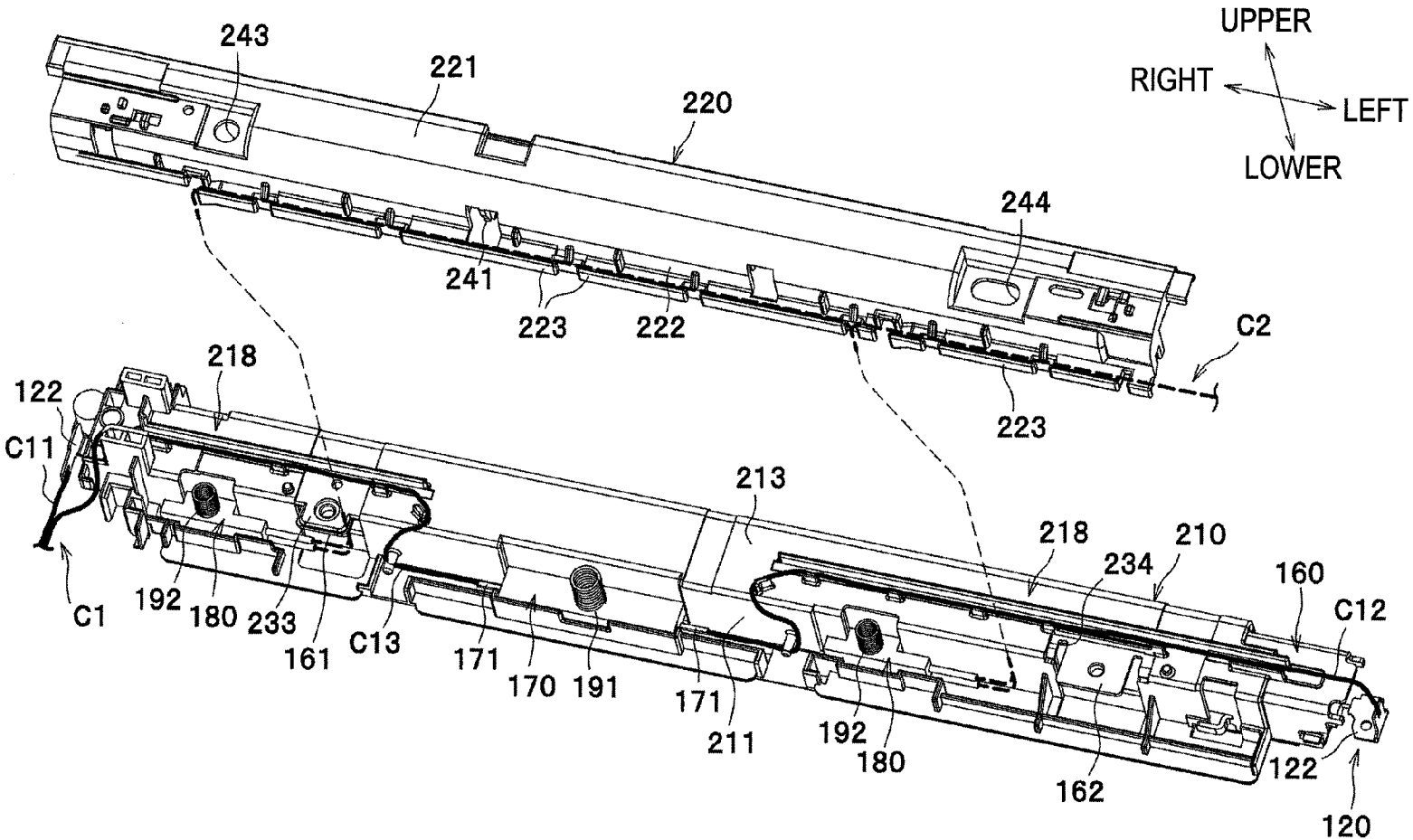
FIG. 6 is a perspective view illustrating an arrangement of a cable.

As shown in FIG. 2, the fuser unit 100 mainly has a fixing film 110 that is an example of a cylindrical member, a halogen lamp 120 that is an example of a heat generator, a nip plate 130 that is an example of a nip member, a pressing roller 140 that is an example of a backup member, a reflection member 150 and a stay member 160 that are examples of a conductive member, a thermostat 170 and two thermistors 180 (refer to FIGS. 3 and 4) that are examples of a temperature detection unit, coil springs 191, 192 (urging members) (refer to FIGS. 3 and 4), a frame member 200 and a cable (wiring) C1 (refer to FIG. 6).

The fixing film 110 is a film of an endless shape (cylindrical shape) having heat resistance and flexibility, and rotation thereof is guided by a guide member (not shown). In this illustrative embodiment, the fixing film 110 is made of metal, for example stainless steel, nickel and the like.

The halogen lamp 120 is a member that generates radiation heat to heat the nip plate 130 and the fixing film 110 (nip part N), thereby heating the toners on the sheet S. The halogen lamp is arranged at the inside of the fixing film 110 at a predetermined interval from inner surfaces of the fixing film 110 and the nip plate 130.

Figure 3:
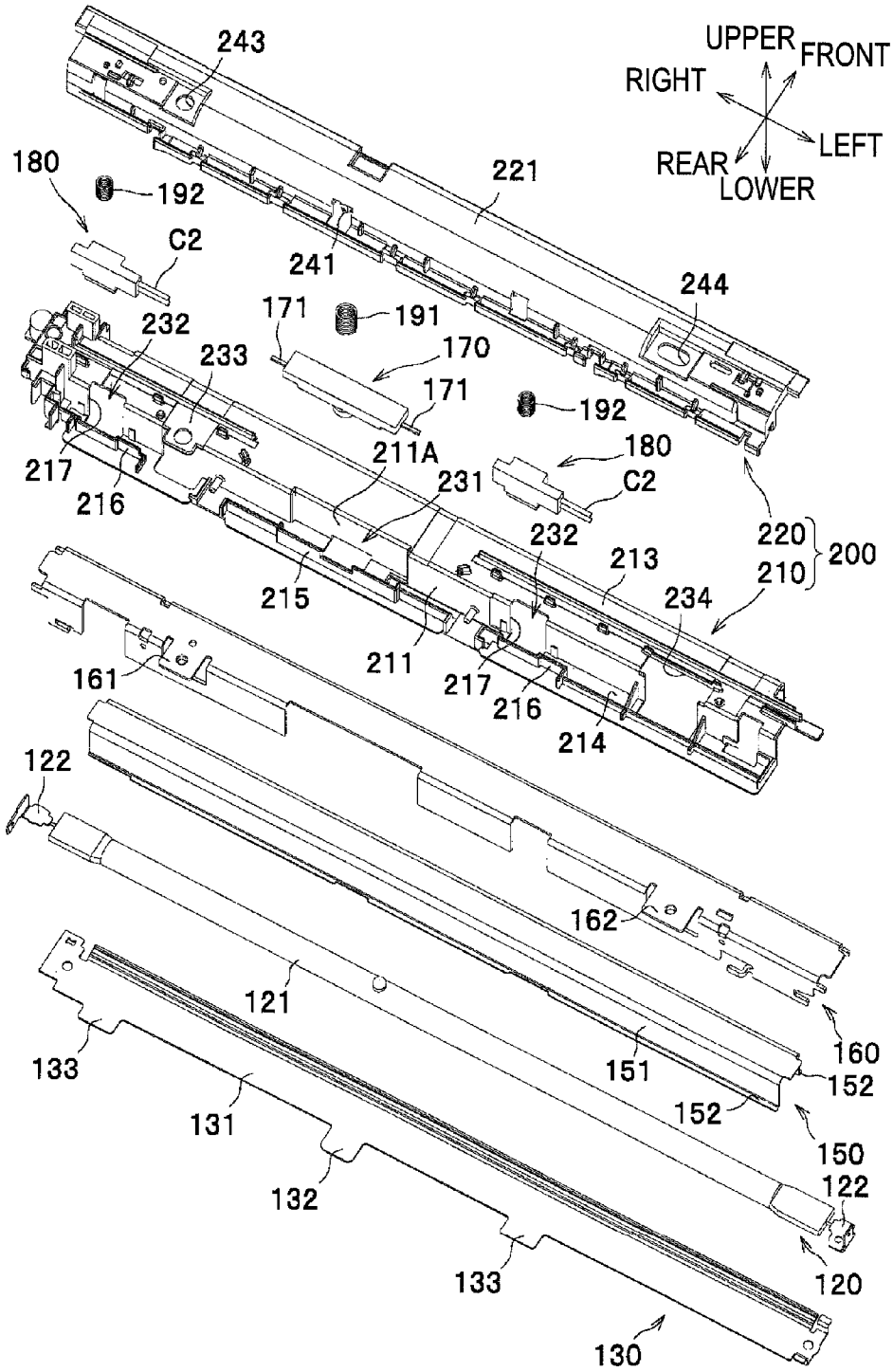
FIG. 3 is a perspective view illustrating a nip plate, a halogen lamp, a reflection member, a stay member, a first frame, a thermostat, thermistors, coil springs and a second frame.

As shown in FIG. 3, the halogen lamp 120 is formed by arranging a filament (not shown) having a spirally wound coil portion in an elongated glass tube 121, closing both longitudinal end portions of the glass tube 121 and enclosing inert gases including halogen element in the glass tube. A pair of electrodes 122 electrically connected to end portions of the filament in the glass tube 121 is mounted on both longitudinal end portions of the halogen lamp 120.

Again referring to FIG. 2, the nip plate 130 is a plate-shaped member to which radiation heat from the halogen lamp 120 is applied and a lower surface thereof is arranged to slidingly contact an inner peripheral surface of the cylindrical fixing film 110. In this illustrative embodiment, the nip plate 130 is made of metal, and for example is formed by bending an aluminum plate and the like having thermal conductivity higher than the stay member 160 made of steel, which will be described later.

As shown in FIG. 3, the nip plate 130 has a base part 131, a first protrusion 132 and a second protrusion 133.

The base part 131 is a part having a lower surface slidingly contacting the inner peripheral surface of the fixing film 110 and transfers the heat from the halogen lamp 120 to the toners on the sheet S through the fixing film 110.

The first protrusion 132 and the second protrusions 133 are formed to protrude rearward from a rear end of the base part 131, in a conveyance direction of the sheet S, along the conveyance direction. The one first protrusion 132 is formed near the center of the rear end of the base part 131 in the left-right direction, and the thermostat 170 is arranged to face an upper surface of the first protrusion. Also, the second protrusions 133 are respectively formed near the center and near a right end portion of the rear end of the base part 131 in the left-right direction, and the thermistors 180 are arranged to face upper surfaces of the second protrusions.

As shown in FIG. 2, the pressing roller 140 is a member forming a nip part N between the fixing film 110 and the pressing roller by nipping the fixing film 110 between the nip plate 130 and the pressing roller, and is arranged below the nip plate 130. In this illustrative embodiment, in order to form the nip part N, one of the nip plate 130 and the pressing roller 140 is urged toward the other of the nip plate 130 and the pressing roller 140.

The pressing roller 140 is configured to rotate as driving force is transferred thereto from a motor (not shown) provided in the body housing 2. As the pressing roller rotates, it rotates the fixing film 110 by frictional force with the fixing film 110 (or sheet S). As the sheet S having the toner image transferred thereto is conveyed between the pressing roller 140 and the heated fixing film 110 (i.e., at the nip part N), the toner image (toners) is heat-fixed.

The reflection member 150 is a member that reflects the radiation heat from the halogen lamp 120 (mainly, the radiation heat radiated toward the front-rear direction or upper direction) toward the nip plate 130, and the reflection member 150 is arranged at a predetermined interval from the halogen lamp 120 so that the reflection member surrounds (covers) the halogen lamp 120 at the inside of the fixing film 110.

The radiation heat from the halogen lamp 120 is converged to the nip plate 130 by the reflection member 150, so that it is possible to efficiently use the radiation heat from the halogen lamp 120. Thus, it is possible to rapidly heat the nip plate 130 and the fixing film 110.

The reflection member 150 is formed by bending an aluminum plate and the like having high reflectance of the infrared and far-infrared into a substantial U shape when seen from the section. Specifically, the reflection member 150 mainly has a reflection part 151 having a bent shape (a substantially U-shaped section) and flange parts 152 extending from front and rear end portions of the reflection part 151 toward the outside of the front-rear direction.

The stay member 160 is a member that supports the front and rear end portions of the nip plate 130 (base part 131) via the reflection member 150 (flange parts 152) to bear load applied from the pressing roller 140, and the stay member 160 is arranged to cover the halogen lamp 120 and the reflection member 150 at the inside of the fixing film 110. Meanwhile, in the configuration in which the nip plate 130 urges the pressing roller 140, the load corresponds to reactive force of the force with which the nip plate 130 urges the pressing roller 140.

The stay member 160 is formed by bending, for example, a steel plate having relatively high rigidity into a shape (a substantially U-shaped section) conforming to an outer surface shape of the reflection member 150 (reflection part 151). As shown in FIG. 3, the stay member 160 has a frame fixing part 161 at the right side and a frame fixing part 162 at the left side in the left-right direction. The frame fixing part 161 and the frame fixing part 162 are formed to extend rearward from an upper wall of the stay member 160 and have a penetrated screw hole (reference numeral thereof is omitted), respectively.

As shown in FIG. 2, the thermostat 170 is a member that detects a temperature of the nip plate 130, has a bimetal and the like (a configuration thereof is not shown) and is configured to cut off the power feeding when detecting a predetermined temperature.

The thermostat 170 is arranged to face an upper surface (a surface opposite to a lower surface slidingly contacting the fixing film 170) of the nip plate 130 (first protrusion 132) at the inside of the fixing film 110. Also, the thermostat 170 is arranged at an opposite side to the halogen lamp 120 with respect to the reflection member 150 and the stay member 160 being interposed therebetween, i.e., at the outside of the reflection member 150 and the stay member 160 (when the side at which the halogen lamp 120 is arranged is referred to as the inside).

The thermostat 170 has, at its both end surfaces, electrodes 171 having a plate shape protruding toward the outside in the left-right direction (refer to FIG. 3). The cable C1 is electrically connected to the electrodes 171 (refer to FIG. 6).

Also, an elastic member 172 contacting the nip plate 130 is provided on a temperature detection surface (a surface facing the nip plate 130) of the thermostat 170. As the elastic member 172, a ceramic sponge and the like having elasticity and heat resistance may be used. The elastic member 172 is adhered on the temperature detection surface of the thermostat 170 by a kapton tape and the like.

Figure 4:
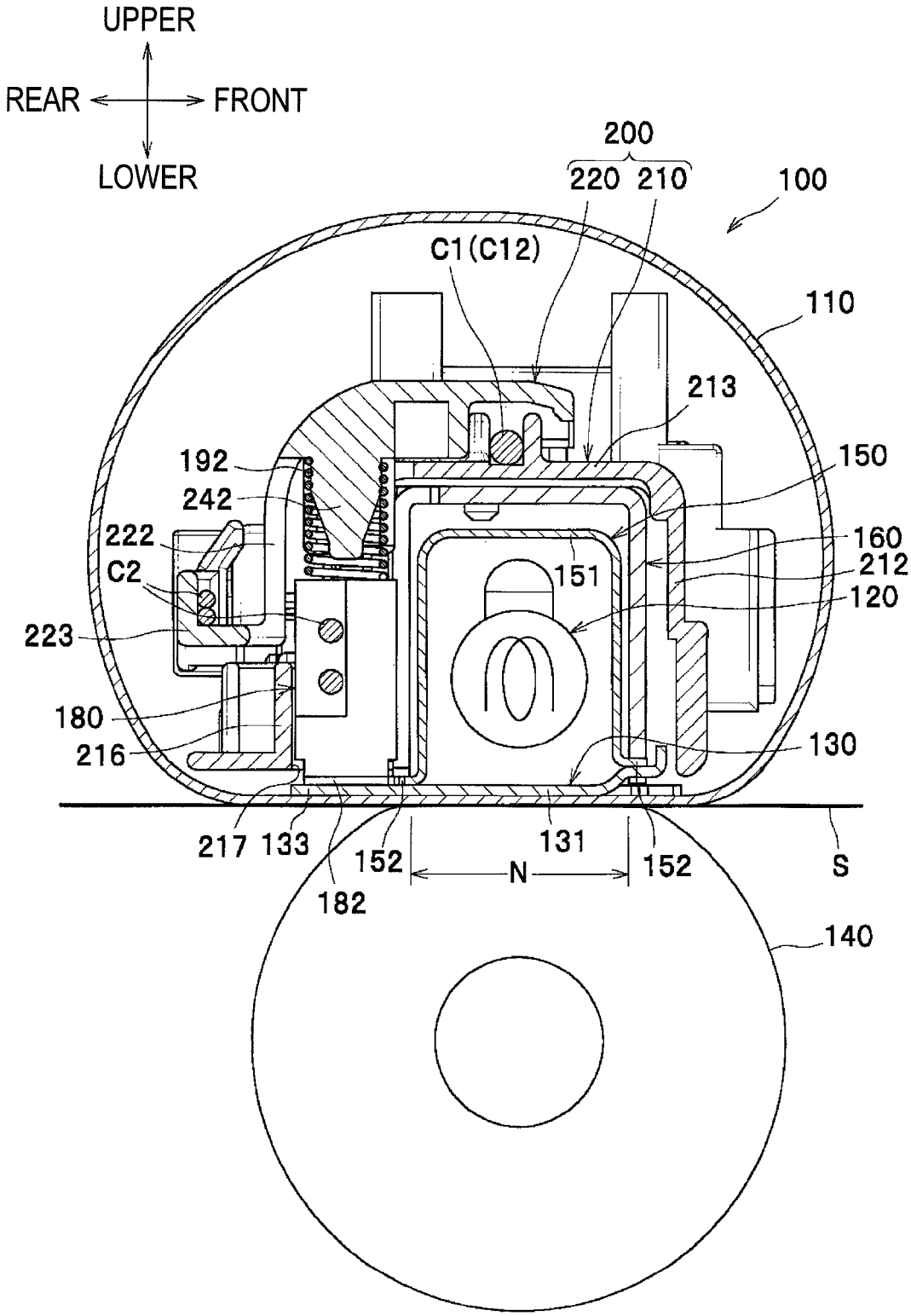
FIG. 4 is a sectional view illustrating a vicinity of the thermistor arranged at a center of the fuser unit in the left-right direction.

As shown in FIG. 4, the thermistor 180 is a temperature sensor that detects the temperature of the nip plate 130, and is arranged to face the upper surface of the nip plate 130 (second protrusion 133) at the inside of the fixing film 110. Also, when seen from an axial direction of the fixing film 110 (the left-right direction), the thermistor 180 is arranged at an opposite side to the halogen lamp 120 (at the outside of the reflection member 150 and the stay member 160) with respect to the reflection member 150 and the stay member 160 being interposed therebetween.

A cable C2 electrically connected to an electrode of a thermistor device (not shown) arranged in a housing of the thermistor 180 is taken out from a left end surface of the thermistor 180. Also, an elastic member 182, which is similar as the elastic member 172 of the thermostat 170 and contacts the nip plate 130, is provided on the temperature detection surface (surface facing the nip plate 130) of the thermistor 180.

As shown in FIGS. 2 and 4, the coil springs 191, 192 are members that urge the thermostat 170 and thermistors 180 toward the nip plate 130 (first protrusion 132 or second protrusions 133) and are arranged so that lower ends thereof contact the upper surface(s) of the thermostat 170 and thermistors 180 at the inside of the fixing film 110. Upper ends of the coil springs 191, 192 are engaged to support parts 241, 242 (which will be described later) of the frame member 200, so that the coil springs are supported to the frame member 200.

The frame member 200 is a member that supports the thermostat 170, the thermistors 180, the coil springs 191, 192 and the like, and is arranged to cover the stay member 160 at the inside of the fixing film 110. The frame member 200 mainly has the first frame 210 and the second frame 220.

As shown in FIG. 2, the first frame 210 has a substantially U-shaped section to cover the stay member 160 and extends along the stay member 160 in the left-right direction (refer to FIG. 3). The first frame 210 is arranged at the opposite side to the halogen lamp 120 with respect to the reflection member 150 and the stay member 160 being interposed therebetween at the inside of the fixing film 110.

In this illustrative embodiment, the first frame 210 is made of an insulating material, for example liquid crystal polymer, PEEK resin, PPS resin and the like. A rear sidewall 211 of the first frame 210 having the insulation property is provided between the electrodes 171 exposed to the outside of the thermostat 170 and the conductive reflection member 160 (made of aluminum) or stay member 160 (made of steel) and secures the insulation between the electrodes 171 and the reflection member 150 or stay member 160. That is, the first frame 210 of this illustrative embodiment is an insulating member.

As shown in FIG. 3, the first frame 210 mainly has the rear sidewall 211, a front sidewall 212 (refer to FIG. 2), an upper wall 213 extending to connect upper ends of the rear sidewall 211 and the front sidewall 212 and a support wall 214 extending rearward from a lower end of the rear sidewall 211. Also, the first frame 210 is mainly formed with a first positioning part 231, second positioning parts 232, a fixing part 233 and a notched part 234.

The first positioning part 231 is a part that positions the thermostat 170 in directions (left-right direction and front-rear direction) orthogonal to the urging direction (upper-lower direction) of the coil spring 191, and is configured by a recess portion 211A that is formed near a center of the rear sidewall 211 in the left-right direction and an upright standing wall 215 upright standing from the support wall 214 and facing the recess portion 211A. The upright standing wall 215 has a substantial U shape, when seen from a plane having a part extending forward from left and right ends.

The recess portion 211A of the rear sidewall 211 and the upright standing wall 215 have a surface following the left-right direction and a surface following the front-rear direction, respectively. The thermostat 170 is configured to be fitted in a part (i.e., first positioning part 231) surrounded by the recess portion 211A and the upright standing wall 215 (refer to FIG. 6). The fitted thermostat 170 is supported by the surface following the left-right direction and the surface following the front-rear direction of the recess portion 211A or upright standing wall 215 and is thus positioned in the left-right direction and the front-rear direction.

In the meantime, a bottom wall (support wall 214) of the first positioning part 231 is formed with an opening (a reference numeral thereof is omitted) enabling the temperature detection surface of the thermostat 170 to face toward the nip plate 130.

The second positioning part 232 is a part that positions the thermistor 180 in the directions orthogonal to the urging direction of the coil spring 192 (left-right direction and front-rear direction), the second positioning part 232 is configured by an upright standing wall 216 provided near a center and a right end of the support wall 214 in the left-right direction and a rear sidewall 211 facing the upright standing wall 216. An opening 217 into which a forward protruding part of the thermistor 180 is fitted is formed near the center of the rear sidewall 211, which configures the second positioning part 232, in the left-right direction.

According to the above configuration, since the part of the rear sidewall 211 configuring the second positioning part 232 has a surface following the left-right direction and a surface following the front-rear direction and the upright standing wall 216 has a surface following the left-right direction, the thermistor 180 can be fitted to the second positioning part 232 (refer to FIG. 6). The fitted thermistor 180 is supported on the rear sidewall 211, the upright standing wall 216 and the surfaces of the opening 217 following the left-right and front-rear directions, so that it is positioned in the left-right and front-rear directions.

In the meantime, since the opening 217 is formed from the rear sidewall 211 to the support wall 214, the temperature detection surface of the thermistor 180 faces toward the nip plate 130 through the opening 217.

The fixing part 233 is a part for fixing the first frame 210 to the stay member 160 (frame fixing part 161) and is provided at the right side of the first frame 210 in the left-right direction. The fixing part 233 is formed with a through-hole (a reference numeral thereof is omitted) having a substantially circular shape when seen from a plan view, corresponding to the screw hole of the frame fixing part 161.

Figure 5A:
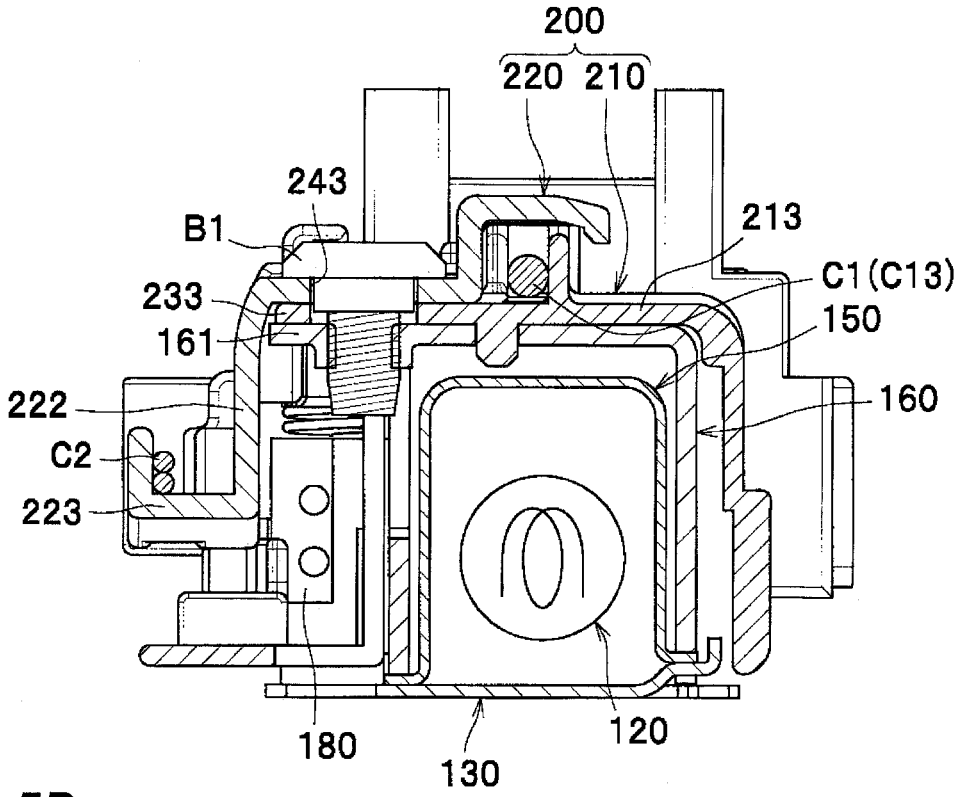
FIG. 5A is a sectional view illustrating a vicinity of a frame fixing part and FIG. 5B is a sectional view illustrating a vicinity of a frame support part.
Figure 5B:
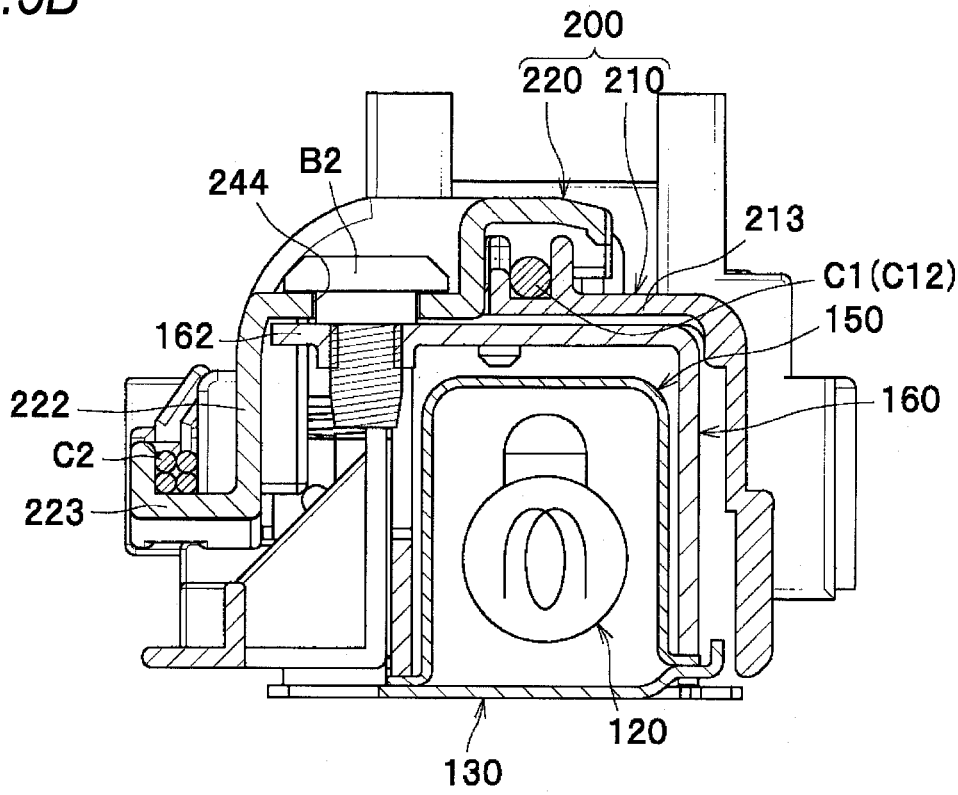

Meanwhile, in this illustrative embodiment, as shown in FIGS. 2, 4 and 5B, most of the first frame 210 is arranged to form a layer-shaped gap between the stay member 160 and the first frame, mostly, and a part of a lower surface of the upper wall 213 in the vicinity of the fixing part 233 contacts the stay member 160, as shown in FIG. 5A. As the layer-shaped gap (space) is formed, the air in the space serves as a heat-insulating layer. Thereby, it is possible to prevent the heat, which is generated from the halogen lamp 120, from being transferred to the outside through the first frame 210.

As shown in FIG. 3, the notched part 234 is provided over the upper wall 213, the rear sidewall 211 and the support wall 214 at the left side of the first frame 210 in the left-right direction. As shown in FIG. 6, when the first frame 210 and the stay member 160 are assembled, the frame support part 162 of the stay member 160 is exposed through the notched part 234. The notched part 234 has a left-right width larger than a left-right length of the exposed frame support part 162.

As shown in FIG. 2, the second frame 220 has a substantially L-shaped section so as to cover the first frame 210 from the above and extends along the first frame 210 in the left-right direction (refer to FIG. 3). The second frame 220 is arranged at the opposite side to the stay member 160 or reflection member 150 with respect to the first frame 210 being interposed therebetween, at the inside of the fixing film 110. In this illustrative embodiment, the second frame 220 is also made of an insulating material, for example liquid crystal polymer, PEEK resin, PPS resin and the like.

As shown in FIGS. 2 to 4, the second frame 220 mainly has, on an upper wall 221 thereof, a first support part 241 supporting the coil spring 191, two second support parts 242 supporting the coil springs 192, a through-hole 243 formed in correspondence to the screw hole of the frame fixing part 161 and a through-hole 244 formed in correspondence to the screw hole of the frame support part 162. The through-hole 244 has a substantially long hole shape in the left-right direction, when seen from the plan view.

As shown in FIG. 2, the first support part 241 protrudes downward from a rear end side of a lower surface of a central part (part corresponding to the first positioning part 231 of the first frame 210) of the upper wall 221 in the left-right direction and is formed to face the nip plate 130 (first protrusion 132) with the thermostat 170 being interposed therebetween. The coil spring 191 is engaged to the first support part 241 having the protuberant shape, so that it is supported to the first support part 241 (frame member 200).

As shown in FIG. 4, the second support parts 242 protrude downward from a rear end side of a lower surface at the center and right end (corresponding to the second positioning parts 232 of the first frame 210) of the upper wall 221 in the left-right direction, and are formed to face the nip plate 130 (second protrusions 133) with the thermistors 180 being interposed therebetween. The coil springs 192 are engaged to the second support parts 242 having the protuberant shape, so that it is supported to the second support parts 242 (frame member 200).

In this illustrative embodiment, a method of assembling the stay member 160, the thermostat 170, the thermistors 180, the coil springs 191, 192 and the frame member 200 is briefly described.

As shown in FIG. 3, the first frame 210 is assembled to the stay member 160 as if it covers the stay member. Then, the thermostat 170 is fitted to the first positioning part 231 and the thermistors 180 are fitted in each of the second positioning parts 232. Also, the coil spring 191 is attached to the first support part 241 of the second frame 220 and the coil springs 192 are attached to the second support parts 242.

Then, the second frame 220 is assembled to the first frame 210 assembled to the stay member 160 to cover the first frame 210. Finally, as shown in FIG. 5A, a screw B1 is enabled to pass through the through-hole 243 of the second frame 220 and the through-hole of the first frame 210 (fixing part 233) and is screwed into the screw hole of the stay member 160 (frame fixing part 161), so that the first frame 210 and the second frame 22 (frame member 200) are fixed to the stay member 160.

Also, as shown in FIG. 5(*b*), a screw B2 is passed through the through-hole 244 of the second frame 220 and is screwed into the screw hole of the stay member 160 (frame support part 162) exposed through the notched part 234 (refer to FIG. 3) of the first frame 210. Thereby, the stay member 160, the thermostat 170, the thermistors 180, the coil springs 191, 192 and the frame member 200 are assembled.

In this illustrative embodiment, since the first frame 210 is formed with the positioning parts 231, 232 and the second frame 220 is formed with the support parts 241, 242, it is possible to perform the assembling in order of the thermostat 170, the thermistors 180 and the coil springs 191, 192 and to thus easily assemble the fuser unit 100.

In the meantime, the first frame 210 and the second frame 220 are supported so that the fixing part 233 and through-hole 243-side (one side) is fixed to the stay member 160 (frame fixing part 161) and the notched part 234 and elongated through-hole 244 side (the other side) larger than the frame support part 162 has a play in the left-right direction with respect to the stay member 160 (frame support part 162). Thereby, even when the stay member 160 is linearly expanded due to the heat transfer to the stay member 160, the expansion is to be absorbed.

As shown in FIG. 6, the cable C1 (refer to the thick solid line) is a conducting wire for feeding power to the halogen lamp 120, is connected to the halogen lamp 120 and the thermostat 170, and is taken out from the right end portion of the fixing film 110. Specifically, the cable C1 includes a conducting wire C11 that is connected to the right electrode 122 of the halogen lamp 120 and conducting wires C12, C13 that are directly or indirectly connected to the left electrode 122 of the halogen lamp 120.

The conducting wire C12 extends rightward from the left electrode of the halogen lamp 120 over the upper wall 213 of the first frame 210, extends downward along the rear sidewall 211 near the center of the first frame 210 in the left-right direction, and is then connected to the left electrode 171 of the thermostat 170. Also, the conducting wire C13 that is connected to the right electrode 171 of the thermostat 170 extends upward along the rear sidewall 211, extends rightward over the upper wall 213 of the first frame 210 and is taken out from the right end portion of the fixing film 110 together with the conducting wire C11.

In the meantime, a guide part 218 that guides the cable C1 is formed in the vicinity of both ends of the upper surface of the upper wall 213 of the first frame 210. An end portion of the cable C1 taken out from the right end portion of the fixing film 110 is connected to a power supply substrate (not shown) mounted in the body housing 2. Thereby, it is possible to feed the power to the halogen lamp 120 (fuser unit 100).

By the above wiring structure, the cable C1 (conducting wires C12, C13) is arranged between the first frame 210 and the second frame 220 in the fuser unit 100, as shown in FIGS. 4 and 5. Thereby, the cable C1 faces the conductive stay member 160 via the first frame 210 having insulation and faces the conductive fixing film 110 via the second insulating frame 220 at the inside of the fixing film 110.

Also, as shown in FIG. 6, the thermostat 170 is connected to the middle of the cable C1 (between the conducting wire C12 and the conducting wire C13). Thereby, when the nip plate 130 is overheated, the thermostat 170 interrupts the power feeding, so that it is possible to rapidly cut off the power feeding to the halogen lamp 120.

In the meantime, the cable C2 extending from the thermistors 180 (refer to the thick broken line) extends upward, passes to a cable support part 223, which is provided on the rear sidewall 222 of the second frame 220 and has a substantially L-shaped section, extends leftward, and is then taken out from the left end portion of the fixing film 110. An end portion of the cable C2 taken out from the left end portion of the fixing film 110 is connected to a control substrate (not shown) mounted in the body housing 2. A detection result of the thermistors 180 is output to the control substrate and is used to control the halogen lamp 120 (fuser unit 100).

According to the illustrative embodiment, following operational effects can be realized.

The nip plate 130, to which the radiation heat from the halogen lamp 120 is directly applied, and the coil springs 191, 192, which urge the thermostat 170 and thermistors 180 toward the nip plate 130, are provided, so that it is possible to stabilize a positional relation between the thermostat 170 and thermistors 180 and the nip plate 130 that is a detection object. Thereby, since it is possible to detect the temperature of the nip plate 130 in good precision, it is possible to control the fixing temperature in good precision.

Since the frame member 200 supporting the coil springs 191, 192 is fixed to the stay member 160 having high rigidity, to which the load from the pressing roller 140 is applied, it is possible to stably support the coil springs 191, 192. Accordingly, since it is possible to apply the urging force to the thermostat 170 and thermistors 180 in good precision, it is possible to further stabilize the positional relation between the thermostat 170 and thermistors 180 and the nip plate 130.

The frame member 200 has the support parts 241, 242 supporting the coil springs 191, 192 and the positioning parts 231, 232 positioning both the thermostat 170 and thermistors 180 in the left-right direction and in the front-rear direction. Accordingly, it is possible to further stabilize the positional relation between the thermostat 170 and thermistors 180 and the nip plate 130.

The frame member 200 has, as the separate components, the first frame 210 having the positioning parts 231, 232 and the second frame 220 having the support parts 241, 242. Therefore, it is possible to sequentially (separately) assemble the thermostat 170, the thermistors 180 and the coil springs 191, 192. Thereby, it is possible to simply assemble the fuser unit 100, compared to a frame configuration in which the thermostat 170, the thermistors 180 and the coil springs 191, 192 are assembled at a time.

Since the first frame 210 (insulating member) is provided between the electrodes 171 of the thermostat 170, which are exposed to the outside, and the conductive reflection member 150 or stay member 160, it is possible to secure the insulation between the electrodes 171 and the reflection member 150 or stay member 160.

Since the elastic members 172, 182 contacting the nip plate 130 are provided on the temperature detection surfaces of the thermostat 170 and thermistors 180, it is possible to closely contact the thermostat 170 and thermistors 180 while following the surface shape of the nip plate 130. Accordingly, it is possible to detect the temperature of the nip plate 130 in good precision.

Since the nip plate 130 is made of metal, it is possible to transfer the radiation heat applied from the halogen lamp 120 favorably and uniformly. Accordingly, it is possible to transfer the heat to the toners on the sheet S favorably and uniformly and to precisely detect the temperature thereof at the thermostat 170 and thermistors 180.

The cable C1 is arranged between the first frame 210 and the second frame 220. Therefore, it is possible to secure the thermal insulation properties between the cable C1 and the halogen lamp 120 and to secure the insulation properties between the cable C1 and the stay member 160 by the first insulating frame 210 that is arranged at the opposite side to the halogen lamp 120 with respect to the stay member 160 being interposed therebetween and extends along the stay member 160. Also, it is possible to suppress the interference (contact) between the cable C1 and the inner peripheral surface of the fixing film 110 by the second frame 220 that is arranged at the opposite side to the stay member 160 with respect to the first frame 210 being interposed therebetween and extends along the first frame 210.

The first frame 210 is arranged so that the layer-shaped gap is formed between the first frame 210 and the stay member 160. Thus, the air in the layer-shaped gap serves as a heat-insulating layer, so that it is possible to suppress the heat, which is generated from the halogen lamp 120, from being transferred to the outside. Thereby, since it is possible to suppress the heat loss in the fuser unit 100, it is possible to rapidly heat the nip plate 130 and thus to quickly start up the fuser unit 100.

The first frame 210 and the second frame 220 are supported so that the one side of the left-right direction is fixed to the stay member 160 and the other side has a play in the left-right direction with respect to the stay member 160. Thereby, even when the stay member 160 is linearly expanded, the expansion is to be absorbed. Hence, it is possible to suppress the deformation of the first frame 210, the second frame 220 and the stay member 160.

Since the fixing film 110 is made of metal, it is possible to improve the thermal conductivity or strength (rigidity) of the fixing film 110. In the configuration in which the fixing film 110 is made of metal, the second frame 220 suppresses the interference between the cable C1 and the inner peripheral surface of the fixing film 110 has insulation. Therefore, it is possible to secure the insulation between the cable C1 and the fixing film 110.

The first frame 210 is formed to cover the conductive member, and the second frame 220 is formed to cover the first frame 210. Accordingly, it is possible to cover the cable C1 by the first frame 210 and the second frame 220 at the inside of the fixing film 110. Thereby, it is possible to secure certainly the thermal insulation properties and the insulation properties of the cable C1 and to suppress securely the interference between the cable C1 and the fixing film 110.

The thermostat 170 is connected to the middle of the cable C1 for feeding the power to the halogen lamp 120. Thus, when the nip plate 130 is overheated, the thermostat 170 interrupts the power feeding, so that it is possible to rapidly cut off the power feeding to the halogen lamp 120.

Although the illustrative embodiment of this disclosure has been described, it should be understood that this disclosure is not limited to the illustrative embodiment. The specific configuration can be appropriately changed without departing from the scope of this disclosure.

In the above illustrative embodiment, the configurations of the positioning parts 231, 232 and the support parts 241, 242 are just exemplary and this disclosure is not limited thereto. For example, the positioning part may be an opening that is formed on the support wall 214 of the first frame 210 and the temperature detection unit can be fitted therein. Also, for example, another example of the support part may be a recess part to which a plate spring serving as the urging member is engaged.

In the above illustrative embodiment, the frame member 200 has the first frame 210 having the positioning parts 231, 232 and the second frame 220 having the support parts 241, 242, which are the separate components. However, this disclosure is not limited thereto. That is, both the support part and the positioning part may be provided to a frame member configured as a single component.

In the above illustrative embodiment, the first frame 210 has been exemplified as the insulating member. However, this disclosure is not limited thereto. For example, in the above illustrative embodiment, the stay member 160, which is provided between the electrodes 171 of the thermostat 170 and the conductive reflection member 150, may be configured as an insulating member (insulation property). Also, when the electrodes of the temperature detection unit are accommodated in a housing of the temperature detection unit, the housing itself of the temperature detection unit may be configured as an insulating member.

In the above illustrative embodiment, the elastic members 172, 182 contacting the nip plate 130 are provided on the temperature detection surfaces of the thermostat 170 and thermistors 180. However, this disclosure is not limited thereto. That is, according to this disclosure, the elastic member is an arbitrary member and may not be provided. Meanwhile, in the configuration in which the elastic member is not provided, the temperature detection surface of the temperature detection unit may contact the nip member, or not.

In the above illustrative embodiment, the frame member 200 supporting the coil springs 191, 192 (urging members) is fixed to the stay member 160. However, this disclosure is not limited thereto. For example, the frame member may be fixed to a guide member that guides the rotation of the cylindrical member. Meanwhile, in order to stably support the urging members, the frame member may be fixed to a member having high rigidity.

In the above illustrative embodiment, the first frame 210 and the second frame 220 are supported so that the one side of the left-right direction is fixed to the stay member 160 and the other side has a play in the left-right direction with respect to the stay member 160. However, this disclosure is not limited thereto. For example, the first frame and the second frame may be supported so that the center in the axial direction of the cylindrical member is fixed to the stay member and both ends has a play in the axial direction of the cylindrical member the with respect to the stay member.

In the above illustrative embodiment, the first frame 210 is arranged so that the layer-shaped gap is formed between the first frame and the stay member 160. However, this disclosure is not limited thereto. For example, a layer such as heat insulating member and heat reflection member may be provided between the first frame and the stay member. Also, the first frame may be formed of a heat insulation material and arranged to contact the stay member.

In the above illustrative embodiment, the coil springs 191, 192 are exemplified as the urging member. However, this disclosure is not limited thereto. For example, a spring member such as plate spring, other than the coil spring, a foamed elastic member that can be elastically deformable, and the like may be used.

In the above illustrative embodiment, the fixing film 110 (cylindrical member) is made of metal. However, this disclosure is not limited thereto. For example, the fixing film may be formed of a polyimide resin and the like. Further, according to this disclosure, the cylindrical member made of metal may have a covering layer (for example, Teflon (registered trademark) layer for reducing sliding resistance) on the surface thereof.

In the above illustrative embodiment, the configuration has been exemplified in which both the reflection member 150 and the stay member 160 are provided. However, this disclosure is not limited thereto. For example, a configuration in which only the stay member is provided (the reflection member is not provided) and a configuration in which both the reflection member and the stay member are not provided may be also possible. Also, when the reflection member is not provided, a reflective surface may be formed on a surface of the stay member facing the heat generator.

In the above illustrative embodiment, the halogen lamp 120 (halogen heater) is exemplified as the heat generator. However, this disclosure is not limited thereto. For example, an infrared heater, a carbon heater and the like may be also used.

In the above illustrative embodiment, the pressing roller 140 is exemplified as the backup member. However, this disclosure is not limited thereto. For example, the backup member may be a belt-type pressing member and the like.

In the above illustrative embodiment, the sheet S such as normal sheet and postcard has been exemplified as the recording sheet. However, this disclosure is not limited thereto. For example, an OHP sheet and the like may be used.

In the above illustrative embodiment, the laser printer 1 that forms a black-and-white image is exemplified as the image forming apparatus having the fuser unit of this disclosure. However, this disclosure is not limited thereto. For example, a printer that forms a color image may be also possible. Also, the image forming apparatus is not limited to the printer and may be a copier or complex machine having a document reading device such as flat bed scanner.

What is claimed is:

1. A fuser unit comprising:

a cylindrical member having flexibility;

a heat generator arranged inside the cylindrical member;

a plate-shaped nip member arranged to slidingly contact an inner peripheral surface of the cylindrical member and configured to receive radiation heat from the heat generator;

a backup member configured to form a nip part between the cylindrical member and the backup member, by nipping the cylindrical member between the backup member and the nip member;

a temperature detection unit arranged to face an opposite surface that is opposite to a surface of the nip member configured to slidingly contact the inner peripheral surface of the cylindrical member and configured to detect a temperature of the nip member;

an urging member configured to urge the temperature detection unit toward the nip member;

a frame member arranged inside the cylindrical member and configured to support the urging member; and a stay member arranged inside the cylindrical member and configured to support the nip member, and to which a load from the backup member is applied, wherein the frame member is fixed to the stay member.

2. The fuser unit according to claim 1, wherein the frame member includes:

a support part that supports the urging member; and a positioning part that positions the temperature detection unit in a direction orthogonal to an urging direction of the urging member.

3. The fuser unit according to claim 2, wherein the temperature detection unit is configured to be fitted to the positioning part by a wall of the frame member having a surface following a direction orthogonal to the urging direction of the urging member.

4. The fuser unit according to claim 2, wherein the frame member includes:

a first frame arranged at an opposite side to the heat generator with respect to the stay member being interposed therebetween, the first frame including the positioning part; and a second frame arranged at an opposite side to the stay member with respect to the first frame being interposed therebetween, the second frame including the support part that is formed to face the nip member with the temperature detection unit being interposed therebetween.

5. The fuser unit according to claim 1, further comprising:

a conductive member arranged to cover the heat generator inside the cylindrical member; and an insulating member provided between an electrode of the temperature detection unit and the conductive member.

6. The fuser unit according to claim 1, wherein a surface of the temperature detection unit facing the nip member is provided with an elastic member contacting the nip member.

7. The fuser unit according to claim 1, wherein the nip member is made of metal.

8. The fuser unit according to claim 1, wherein the temperature detection unit contacts the opposite surface of the nip member.

9. The fuser unit according to claim 1, wherein the heat generator includes a halogen lamp.

10. A fuser unit comprising:

a cylindrical member having flexibility;

a heat generator arranged inside the cylindrical member;

a plate-shaped nip member arranged to slidingly contact an inner peripheral surface of the cylindrical member and configured to receive radiation heat from the heat generator;

a backup member configured to form a nip part between the cylindrical member and the backup member, by nipping the cylindrical member between the backup member and the nip member;

a temperature detection unit arranged to face an opposite surface that is opposite to a surface of the nip member configured to slidingly contact the inner peripheral surface of the cylindrical member and configured to detect a temperature of the nip member, the temperature detection unit having a surface facing the nip member, the surface facing the nip member being provided with an elastic member contacting the nip member; and an urging member configured to urge the temperature detection unit toward the nip member.

11. The fuser unit according to claim 10, further comprising:

a frame member arranged inside of the cylindrical member and configured to support the urging member; and a stay member arranged inside of the cylindrical member and configured to support the nip member, and to which a load from the backup member is applied, wherein the frame member is fixed to the stay member.

12. The fuser unit according to claim 11, wherein the frame member includes:

a support part that supports the urging member; and a positioning part that positions the temperature detection unit in a direction orthogonal to an urging direction of the urging member.

13. The fuser unit according to claim 12, wherein the temperature detection unit is configured to be fitted to the positioning part by a wall of the frame member having a surface following a direction orthogonal to the urging direction of the urging member.

14. The fuser unit according to claim 12, wherein the frame member includes:

a first frame arranged at an opposite side to the heat generator with respect to the stay member being interposed therebetween , the first frame including the positioning part; and a second frame arranged at an opposite side to the stay member with respect to the first frame being interposed therebetween, the second frame including the support part that is formed to face the nip member with the temperature detection unit being interposed therebetween.

15. The fuser unit according to claim 10, further comprising:

a conductive member arranged to cover the heat generator inside the cylindrical member; and an insulating member provided between an electrode of the temperature detection unit and the conductive member.

16. The fuser unit according to claim 10, wherein the nip member is made of metal.

17. The fuser unit according to claim 10, wherein the heat generator includes a halogen lamp.

18. The fuser unit according to claim 10, wherein the elastic member includes a sponge.

19. The fuser unit according to claim 10, wherein the elastic member includes a ceramic sponge.

20. A fuser unit comprising:

a cylindrical member;

a heater;

a nip plate spaced apart from the heater, the nip plate comprising:

a first surface contactable with an inner peripheral surface of the cylindrical member; and a second surface opposite to the first surface;

a roller, the roller and the first surface of the nip plate being configured to pinch the cylindrical member therebetween;

a temperature sensor including an elastic member contacting the second surface of the nip plate; and a spring urging the temperature sensor toward the second surface of the nip plate.

* * * * *